US009181961B1

(12) United States Patent
Lucas et al.

(10) Patent No.: US 9,181,961 B1
(45) Date of Patent: Nov. 10, 2015

(54) COMPRESSOR INTAKE NOISE PREVENTION BY CHOKING FLOW WITH DUCT GEOMETRY

(71) Applicant: BorgWarner Inc., Auburn Hills, MI (US)

(72) Inventors: Evan Lucas, Asheville, NC (US); Sean Hastings, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 14/623,897

(22) Filed: Feb. 17, 2015

(51) Int. Cl.

| | |
|---|---|
| ***F04D 21/00*** | (2006.01) |
| ***F04D 29/46*** | (2006.01) |
| ***F04D 29/66*** | (2006.01) |
| ***F04D 17/10*** | (2006.01) |
| ***F01D 17/14*** | (2006.01) |
| ***F02B 37/00*** | (2006.01) |
| ***F04D 27/02*** | (2006.01) |

(52) U.S. Cl.
CPC ..... *F04D 29/667* (2013.01); *F01D 17/14* (2013.01); *F02B 37/00* (2013.01); *F04D 17/10* (2013.01); *F04D 21/00* (2013.01); *F04D 27/0246* (2013.01); *F04D 27/0253* (2013.01); *F04D 29/464* (2013.01)

(58) Field of Classification Search
CPC ... F04D 21/00; F04D 27/002; F04D 27/0246; F04D 29/4206; F04D 29/4213; F04D 29/46; F04D 29/462; F04D 29/464; F02C 7/045; F02C 7/042; F01D 17/12; F01D 17/14; F01D 17/141
USPC ..... 415/1, 150, 151, 156, 157, 181
See application file for complete search history.

(56) References Cited

U.S. PATENT DOCUMENTS

| | | | | |
|---|---|---|---|---|
| 3,741,677 | A * | 6/1973 | Silvern et al. | 415/58.1 |
| 4,693,339 | A * | 9/1987 | Beale et al. | 181/255 |
| 5,530,214 | A * | 6/1996 | Morehead et al. | 181/255 |
| 5,821,475 | A * | 10/1998 | Morehead et al. | 181/255 |
| 6,994,518 | B2 * | 2/2006 | Simon et al. | 415/147 |
| 7,739,865 | B2 * | 6/2010 | Prasad et al. | 60/226.1 |
| 7,775,759 | B2 * | 8/2010 | Sirakov et al. | 415/1 |
| 8,690,519 | B2 * | 4/2014 | Aalburg et al. | 415/1 |
| 2012/0201660 | A1 * | 8/2012 | Aalburg et al. | 415/169.2 |

* cited by examiner

*Primary Examiner* — Edward Look
*Assistant Examiner* — Jesse Prager
(74) *Attorney, Agent, or Firm* — BrooksGroup

(57) ABSTRACT

A number of variations may include a product for use with a turbocharger system may include a compressor wheel for charging a flow stream. A housing may be disposed around the compressor wheel, defining an inlet passage and a discharge passage. The flow stream may extend through the inlet passage, around the compressor wheel and through the outlet passage. The inlet passage may be configured to impart a supersonic speed to the flow stream to inhibit sound from propagating against the flow stream through the inlet passage.

22 Claims, 3 Drawing Sheets

COMPRESSOR INTAKE NOISE PREVENTION BY CHOKING FLOW WITH DUCT GEOMETRY

TECHNICAL FIELD

The field to which the disclosure generally relates includes turbocharger systems for use with internal combustion engines and in particular, includes turbocharger design and construction to address sound generated by the turbocharger's operation.

BACKGROUND

A turbocharger for use with an internal combustion engine typically includes a compressor that may be driven by a turbine or other rotation imparting device. The turbine may have a wheel connected to a compressor wheel by a common shaft that is supported for rotation by bearings. The bearings may be disposed in a housing that is situated between the turbine and the compressor. The shaft and the turbine and compressor wheels may rotate at speeds that approach hundreds of thousands of revolutions per minute. In addition, the turbine may be exposed to high temperature exhaust gases and the resulting heat may be transferred to other system components. Under these harsh, and increasingly demanding operating conditions, the lifespan of a turbocharger is expected to match that of the engine with which it operates. To accomplish that challenge, the design of a turbocharger and its components must be robust to survive as expected, while still being cost effective and competitive.

SUMMARY OF ILLUSTRATIVE VARIATIONS

A product for use with a turbocharger system according to a number of variations may include a compressor wheel for charging a flow stream. A housing may be disposed around the compressor wheel, defining an inlet passage and a discharge passage. The flow stream may extend through the inlet passage, around the compressor wheel and through the outlet passage. The inlet passage may be configured to impart a supersonic speed to the flow stream to inhibit sound from propagating against the flow stream and through the inlet passage.

A number of other variations may include a method of attenuating sound generated by a turbocharger system. A compressor may have an inlet duct, where the compressor induces a flow stream in the inlet duct. The inlet duct may be provided with a variable throat. The variable throat may be varied to accelerate the flow stream to a supersonic speed. The inlet duct may be provided with a section between the variable throat and the compressor that has a diverging profile. The flow stream may be decelerated to a subsonic speed prior to entering the compressor by generating a normal shock in the diverging section.

Other illustrative variations within the scope of the invention will become apparent from the detailed description provided herein. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of variations is merely illustrative in nature and is in no way intended to limit the scope of the invention, its application, or uses.

Figure 1:
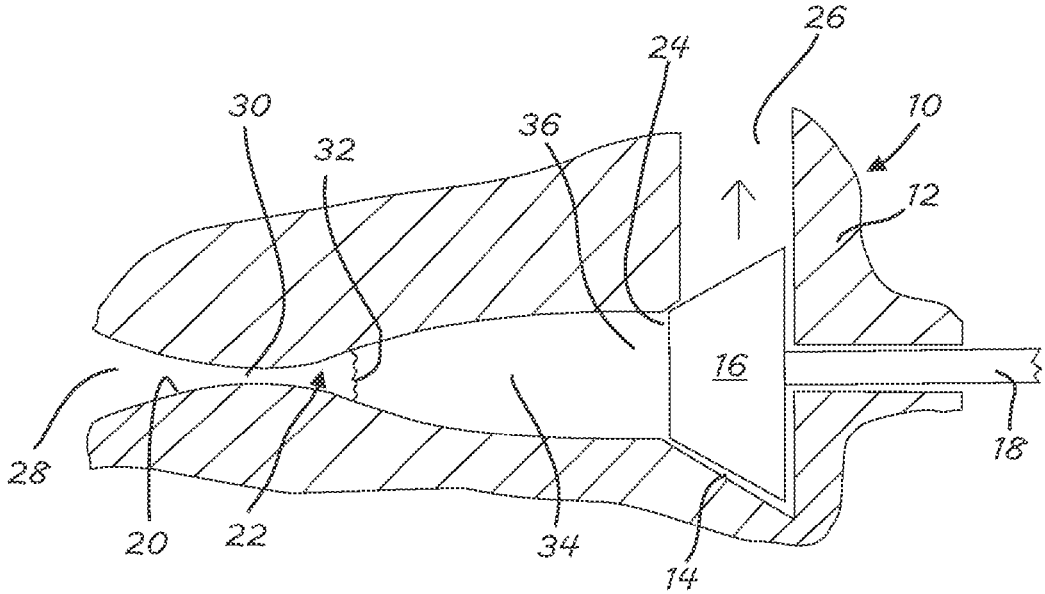
FIG. 1 is a schematic illustration of part of a turbocharger system with a compressor intake arrangement according to a number of variations.

Referring to FIG. 1, in a number of variations a turbocharger assembly 10 may include a housing assembly 12 that may define a chamber 14 containing a compressor wheel 16. The compressor wheel 16 may be connected to a shaft 18, which may provide a motive force to impart rotation to the compressor wheel 16. The housing assembly 12 may also define an inlet duct 20 that provides a passage 22 that leads to the compressor inlet 24 and on to the chamber 14. The inlet duct 20 may be a separate component that connects with the compressor inlet 24, or the two may be formed integrally. The inlet passage 22 may have a rectangular cross section. The housing assembly may also define a discharge passage 26 that leads away from the chamber 14. Rotation of the compressor wheel 16 may induce a flow stream through the inlet passage 22 and may increase pressure thereby charging the flow stream exiting through the discharge passage 26.

Operation of the turbocharger assembly 10 along with the extremely high rotational speeds of the compressor wheel 16 may result in perceivable sounds. The sound sources may propagate from the internal area of the compressor to the external environment through the inlet duct 20. The inlet 28 of the inlet duct 20 may be open to the atmosphere directly or through an associated engine's air intake system. Since the flow of intake air must be relatively unimpeded, sound may escape from inside the compressor to the external environment. Sound propagates through air at a fixed speed, which may be dependent on local pressure, temperature and humidity. According to a number of variations, the inlet duct 20 may be configured to accelerate the speed of the flow stream above the speed of sound so that sound propagation may be prevented through the inlet passage 22 against the flow stream in a direction outward and away from the compressor wheel 16.

The inlet duct 20 may include a throat 30 that has a cross section that is smaller than the cross section of the inlet 28 and that may be variable. This results in a section 34 with a diverging profile of the inlet duct 20 between the inlet 28 and the throat 30. The contour of the inlet duct 20 may form a smooth nozzle. The nozzle may be configured to accelerate the speed of the flow stream to the speed of sound at the throat 30. Acceleration of the flow stream may continue beyond the throat 30 and into a diverging cross section of the inlet passage 22 with a diverging profile. The flow stream may surpass the speed of sound in the diverging section 34 becoming supersonic. The expanding cross sectional area and a pressure differential between the inlet 28 and the compressor inlet 24 may result in a normal shock 32 in the diverging section. A normal shock requires supersonic flow to form and flow becomes subsonic once it crosses the normal shock. Therefore, the normal shock 32 may return the flow stream to subsonic velocity in the segment 34 of the inlet passage 22.

The location of the normal shock 32 may depend on the pressure differential between the pressure at the inlet 24 of the inlet duct 20 and the pressure at the area near the compressor inlet 24. If the pressure differential increases, the normal shock 32 may move toward the compressor inlet 24. Undesirable performance may result if the location of the normal shock 32 moves through the compressor inlet 24 and into the compressor. To inhibit movement of the normal shock 32 to the compressor, the inlet passage 22 may have an expanded cross sectional area in the segment 36 approaching the compressor inlet 24 that is at least five times the cross sectional area of the throat 30. The compressor inlet 24 may be designed with an opening sufficient to accommodate the expanded cross section. In a number of variations, the flow stream may be controlled by varying the size of the inlet passage 22 to limit the maximum velocity to a relatively low supersonic speed such as Mach 1.2. It has been determined that speed limiting may result in a relatively weak normal shock 32 that will not impart excessive losses to the flow stream. According to a number of other variations, the segment 34 of the inlet passage 22 may be configured as a supersonic diffuser. This may be employed to slow the speed of the flow stream and to provide a uniform air flow to the compressor wheel 16.

Figure 2:
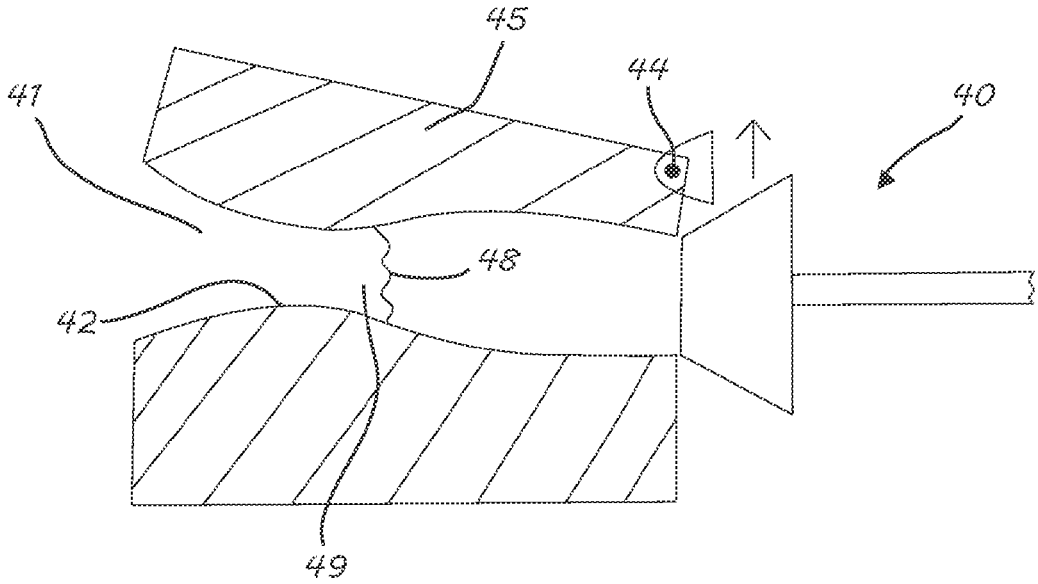
FIG. 2 is schematic illustration of part of a turbocharger system with a compressor intake arrangement according to a number of variations.
Figure 3:
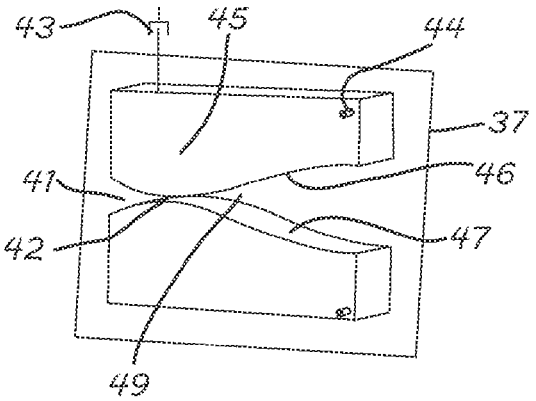
FIG. 3 is a schematic illustration of part of the compressor intake arrangement of FIG. 2.

Because of the variable nature of the flow stream induced by the compressor wheel 16, the throat 30 may be adjustable to compensate for changes in mass flow requirements and in environmental conditions affecting the speed of sound. As shown in FIGS. 2 and 3, a turbocharger assembly 40 may include a mechanism for providing a variable nozzle inlet passage 41. An adjustable cross sectional area of inlet passage 41 including of the throat 42 may be enabled by a hinge 44 that allows an actuator 43 (FIG. 3), to move a housing section 45. The housing section 45 may include part of the nozzle profile that defines the inlet passage 41. As shown by FIG. 3, the cross section of the inlet passage 41 may be rectangular and may be defined between the upper nozzle profile 46, the lower nozzle profile 47, a housing surface 37, and a housing surface forward in the illustration that is not shown for visibility of the inlet passage 41. The inlet passage 41 may be varied to accelerate the speed of the flow stream to supersonic speeds. Once the throat 42 is choked and a normal shock 48 formed in the diverging section 49, compressor sound propagating out of the inlet passage 41 may cease. As mass flow requirements increase for the flow stream and the compressor wheel draws an increased flow through the inlet passage 41, the throat 42 may be opened to limit the supersonic speed. In addition, the turbocharger assembly 40 may be used to deactivate the supersonic feature by opening the throat 42. Deactivation may be desirable during driving events that result in a wide variety of engine operating conditions, such as in heavy traffic or city driving. The supersonic feature may be engaged by reducing the cross section of the throat 42 during consistent driving conditions, such as cruising at highway speeds.

Figure 4:
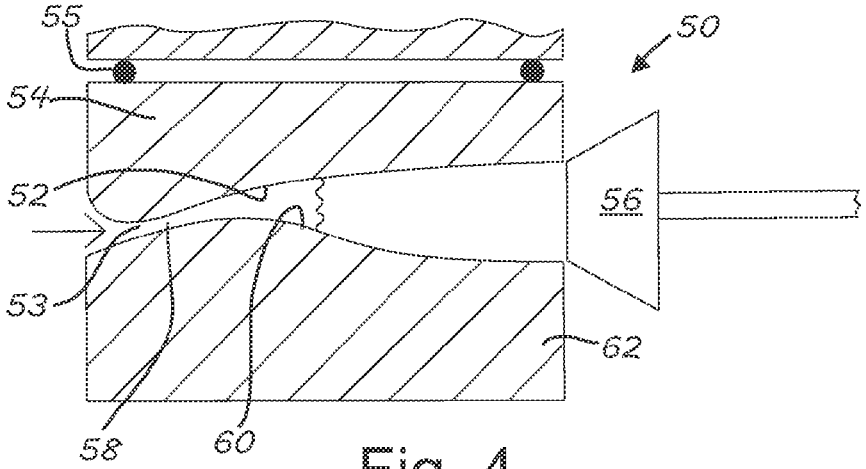
FIG. 4 is a schematic illustration of part of a turbocharger system with a compressor intake arrangement according to a number of variations.

Referring to FIG. 4 a number of other variations may include a turbocharger assembly 50 that may employ a translated geometry for the inlet duct 52 and the inlet passage 53. One segment of the nozzle, the housing section 54, may be configured with bearings 55 to translate toward or away from the compressor wheel 56. The location of the throat 58 and the cross section of the diverging section 60 may be changed based on the location of the section 54 relative to the inlet duct housing section 62. The section 62 may be fixed in place relative to the turbocharger assembly 50.

For the variations illustrated in FIGS. 1-4, to accelerate the air flow stream through the inlet passages 22, 41, 53, the compressor wheel pulls air through the throat 30, 42, 58. This may result in an added flow restriction in comparison to a non-reduced cross section inlet duct. In addition, once supersonic flow is established the normal shock may reduce the total pressure in the flow stream. As a result, the compressor wheel may begin to compress air from a pressure below atmospheric. It has been found that by accelerating the flow stream only slightly above the sonic limit, the normal shock may effect only a slight decrease in total pressure, and a slight increase in air temperature. It has been determined that a flow stream limited to a maximum velocity of Mach 1.2 may result in a total pressure following the normal shock of approximately 0.993 times the total pressure at the duct inlet (atmospheric pressure). Maintaining the pressure at the compressor inlet to over 99% of the pressure at the inlet duct inlet provides acceptable performance of the compressor.

Figure 5:
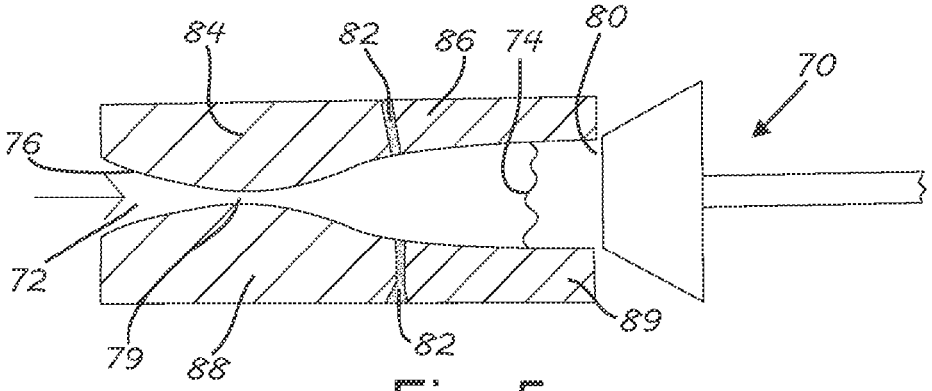
FIG. 5 is a schematic illustration of part of a turbocharger system with a compressor intake arrangement according to a number of variations.

In a number of other variations as illustrated in FIG. 5, a turbocharger assembly 70 may include a variable inlet passage 72 that may be configured to accelerate the flow stream to supersonic speeds resulting in the generation of a normal shock 74. The inlet duct 76 may include sections 84 and 88 that are decoupled from the compressor wheel inlet 80 by an attenuating mechanism 82. The attenuating mechanism 82 may be located at a position upstream from the normal shock 74. The attenuating mechanism may comprise an elastomeric material such as silicone that connects the inlet duct section 84, with section 86 and connects section 88 with section 89. The attenuating mechanism 82 may inhibit the transmission of vibration and sound through the duct wall, enhancing the sound attenuation provided in the inlet passage 72. In addition to providing attenuation, the elastomer in attenuating mechanism 82 may flex and may be used as a hinge to vary the duct section 84 to adjust the cross section of the throat 79.

Figure 6:
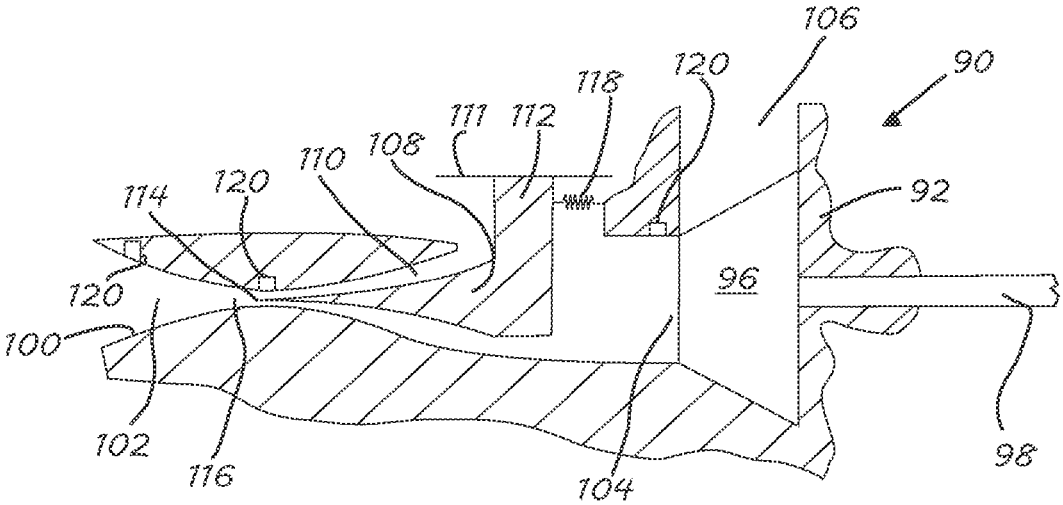
FIG. 6 is a schematic illustration of part of a turbocharger system with a compressor intake arrangement according to a number of variations.

In a number of additional variations a turbocharger assembly 90 as illustrated in FIG. 6 may include a housing assembly 92 that may define a chamber containing a compressor wheel 96. The compressor wheel 96 may be connected to a shaft 98, which may provide a motive force to impart rotation to the compressor wheel 96. The housing assembly 92 may also define an inlet duct 100 that provides a passage 102 that leads to the compressor inlet 104. The inlet passage 102 may have a circular cross section. The housing assembly 92 may also define a discharge passage 106 that leads away from the compressor. Rotation of the compressor wheel 96 may induce a flow stream through the inlet passage 102 and may increase pressure charging the flow stream exiting through the discharge passage 106.

The turbocharger assembly 90 may include a semi-conical shaped center feature 108 that creates a toroidal shaped flow passage 110. The feature 108 may be suspended in the inlet passage 102 by a support 112 that may be configured to be driven to translate the tip 114 through the throat 116 of the inlet passage 102 to reduce the open cross section resulting in accelerated flow. The support may be controlled on a rail 111 with a spring system 118 that automatically adjusts the position of the tip 114 based on the current flow status at the flow passage 110 and the associated pressures. Optionally, a number of sensors 120 may be monitored to determine the desired instantaneous positioning of the tip 114.

Figure 7:
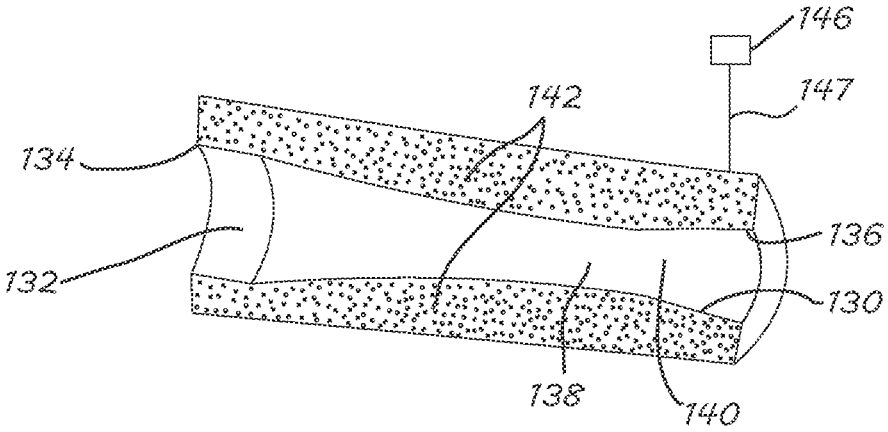
FIG. 7 is a schematic illustration of compressor intake arrangement according to a number of variations.
Figure 8:
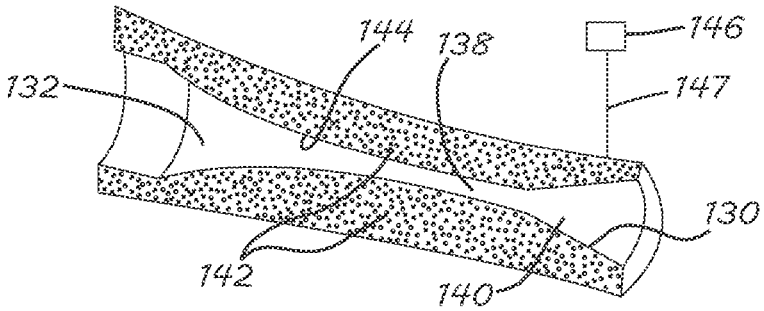
FIG. 8 is a schematic illustration of compressor intake arrangement according to a number of variations.

Referring to FIGS. 7 and 8, in a number of additional variations, an inlet duct 130 for a variable geometry turbocharger inlet passage 132 may be defined by a pliable material that may be elastomeric. The cross section of the inlet passage may be circular or another desired shape. The inlet duct 130 may extend from a duct inlet 134 to a compressor inlet 136 and may define a smooth nozzle with a throat 138 and a diverging segment 140 located between the throat 138 and the compressor inlet 136. The inlet duct 130 may be surrounded by an actuated element 142 that may be a pneumatic bladder. The actuated element 142 may be inflated to provide a narrowed throat 138 as shown in FIG. 8 to accelerate flow through the inlet duct 130 to supersonic speeds. The wall 144 of the inlet duct 130 may be shaped to provide the desired cross section of the inlet duct 130 upon inflation and deflation. The actuated element 142 may be actuated such as by inflation through line 147 by a pressure source 146. Pressure supply may include the boosted intake air at the compressor outlet, such as in the discharge passage 26 of FIG. 1. In a number of other variations the actuator element may be a mechanical device or other sources such as a shape-memory material.

Through the variants, including the products and methods described herein, the geometry of an inlet duct may be configured to arrest sound that may otherwise propagate out of the inlet duct. The description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may include a product for use with a turbocharger system and may include a compressor wheel for charging a flow stream. A housing may be disposed around the compressor wheel, defining an inlet passage and a discharge passage. The flow stream may extends through the inlet passage, around the compressor wheel and through the outlet passage. The inlet passage may be configured to impart a supersonic speed to the flow stream to inhibit sound from propagating against the flow stream through the inlet passage.

Variation 2 may include a product according to variation 1 wherein the inlet passage may include a cross section to slow the flow stream below the supersonic speed before the flow stream reaches the compressor wheel.

Variation 3 may include a product according to variation 1 or 2 wherein the inlet passage may include a throat with a cross section. The cross section may be variable. Variation of the cross section may accelerate and decelerate the flow stream.

Variation 4 may include a product according to any of variations 1 through 3 wherein the inlet passage may be defined by an inlet duct of the housing assembly. The inlet duct may have a throat with a first cross sectional area and a segment adjacent the compressor wheel. The segment may have a second cross sectional area. The second cross sectional area may be at least five times as large as the first cross sectional area.

Variation 5 may include a product according to any of variations 1 through 4 wherein the supersonic speed may be limited to Mach 1.2.

Variation 6 may include a product according to any of variations 1 through 5 wherein the inlet passage may have a cross sectional area that is variable. The housing assembly may include a section connected the housing assembly by a hinge. The section may be rotated on the hinge to vary the cross sectional area.

Variation 7 may include a product according to any of variations 1 through 6 wherein the inlet passage may have a cross sectional area that is variable. The housing assembly may include a section that slides relative to the housing assembly. The section may slide to vary the cross sectional area.

Variation 8 may include a product according to any of variations 1 through 7 wherein the housing assembly may include a first section and a second section. The first and second sections may extend along and define the inlet passage. The first and second sections may be separated by an elastomeric element.

Variation 9 may include a product according to any of variations 1 through 5 and may include a shaped center element that may be positioned in the flow stream creating a toroidal shaped flow passage. The shaped center element may be positioned on a support. The support may be translatable to move the shaped center element along the flow passage to accelerate and decelerate the flow stream.

Variation 10 may include a product according to any of variations 1 through 5 and may include an actuator element. The flow passage may be defined by a wall. The wall may be expandable and contractible by the actuator to accelerate and decelerate the flow stream.

Variation 11 may include a method of attenuating sound generated by a turbocharger system. A compressor may have an inlet duct, where the compressor induces a flow stream in the inlet duct. The inlet duct may be provided with a variable throat. The variable throat may be varied to accelerate the flow stream above a supersonic speed. The inlet duct may be provided with a diverging section between the variable throat and the compressor that has a diverging profile. The flow stream may be decelerated to a subsonic speed by generating a normal shock in the diverging section.

Variation 12 may include a method according to variation 11 and may include the step of limiting the flow stream acceleration to a speed of Mach 1.2.

Variation 13 may include a method according to variation 11 or 12 wherein the throat may have a first cross sectional area. The flow stream may be prevented from entering the compressor at the supersonic speed by providing the diverging section with a second cross sectional area at least five times larger than the first cross sectional area.

Variation 14 may include a method according to any of variations 11 through 13 wherein the turbocharger system may operate with an engine that has an airflow requirement. The variable throat may be varied to provide the flow stream with the subsonic speed throughout the inlet duct when the airflow requirement is changing. The variable throat may be varied to provide the flow stream with the supersonic speed when the airflow requirement is consistent.

Variation 15 may include a method according to any of variations 11 through 14 wherein the inlet duct may be provided with a pneumatic element. The pneumatic element may be provided with pressurized air to vary the throat.

Variation 16 may include a turbocharger system for use with an internal combustion engine and may include a compressor that has a compressor inlet. An inlet duct may connect to the compressor inlet. The inlet duct may define an inlet passage. The compressor may induce a flow stream in the inlet passage. The inlet duct may define a smooth nozzle which may have a converging section leading to a throat and a diverging section between the throat and the compressor inlet. A wall of the inlet duct may include a profile of the converging section, the throat and the diverging section. The wall may be moveable to enlarge and reduce the throat.

Variation 17 may include a turbocharger system according to variation 16 wherein the throat may be variable to accelerate the flow stream to a supersonic speed.

Variation 18 may include a turbocharger system according to variation 16 or 17 wherein the throat may have a first cross sectional area and the diverging section may have a second cross sectional area. The second cross sectional area may be at least five times as large as the first cross sectional area.

Variation 19 may include a turbocharger system according to variation 17 or 18 wherein the supersonic speed may be limited to Mach 1.2.

Variation 20 may include a turbocharger system according to any of variations 16 through 19 wherein a normal shock may be propagated in the flow stream. The flow stream may have a first total pressure before the normal shock and a second total pressure after the normal shock. The second total pressure may be at least ninety-nine percent of the first total pressure.

The above description of select variations within the scope of the invention is merely illustrative in nature and, thus, variations or variants thereof are not to be regarded as a departure from the spirit and scope of the invention.

What is claimed is:

1. A product for use with a turbocharger system comprising:

a compressor wheel for charging a flow stream;

a housing assembly disposed around the compressor wheel, the housing assembly defining an inlet passage and a discharge passage, wherein the flow stream extends through the inlet passage, around the compressor wheel and through the outlet passage;

wherein the inlet passage is configured to impart a supersonic speed to the flow stream to inhibit sound from the compressor wheel from propagating against the flow stream through the inlet passage, wherein the inlet passage includes a throat with a cross section, wherein the cross section is variable, and wherein variation of the cross section accelerates and decelerates the flow stream, wherein the inlet passage includes a contour configured to accelerate the flow stream to a first speed equal to the speed of sound at the throat and to accelerate the flow stream to the supersonic speed beyond the throat and into a diverging cross section of the inlet passage with a diverging profile.

2. The product according to claim 1 wherein the inlet passage includes a cross section to slow the flow stream below the supersonic speed before the flow stream reaches the compressor wheel.

3. The product according to claim 1 wherein the inlet passage is defined by an inlet duct of the housing assembly, wherein the inlet duct has the throat with a first cross sectional area and a segment adjacent the compressor wheel, wherein the segment has a second cross sectional area and wherein the second cross sectional area is at least five times as large as the first cross sectional area.

4. The product according to claim 1 wherein the supersonic speed is limited to Mach 1.2.

5. The product according to claim 1 wherein the inlet passage has a cross sectional area that is variable, and wherein the housing assembly includes a section connected to the housing assembly by a hinge, wherein the section is rotated on the hinge to vary the cross sectional area.

6. The product according to claim 1 wherein the inlet passage has a cross sectional area that is variable and has a nozzle profile, and wherein the housing assembly includes a section that defines a complete side of the nozzle profile and slides relative to the housing assembly, wherein the section slides to vary the cross sectional area.

7. The product according to claim 1 wherein the housing assembly includes a first section and a second section, the first and second sections extending along and defining the inlet passage, wherein the first and second sections are separated by an elastomeric element.

8. The product according to claim 1 further comprising a shaped center element that is positioned in the flow stream and that creates a toroidal shaped flow passage, wherein the shaped center element is positioned on a support and wherein the support is translatable to move the shaped center element along the flow passage to accelerate and decelerate the flow stream.

9. The product according to claim 1 further comprising an actuator wherein the flow passage is defined by a wall, and wherein the wall is expandable and contractible by the actuator to accelerate and decelerate the flow stream.

10. A method of attenuating sound generated by a turbocharger system having a compressor with an inlet duct, where the compressor induces a flow stream in the inlet duct, the method comprising:

providing the inlet duct with a variable throat;

varying the variable throat to accelerate the flow stream above a supersonic speed;

providing the inlet duct with a diverging section between the variable throat and the compressor that has a diverging profile; and decelerating the flow stream to a subsonic speed by generating a normal shock in the diverging section.

11. The method according to claim 10 further comprising the step of limiting the flow stream to a speed of Mach 1.2.

12. The method according to claim 10 wherein the throat has a first cross sectional area and further comprising the step of preventing the flow stream from entering the compressor at the supersonic speed by providing the diverging section with a second cross sectional area at least five times larger than the first cross sectional area.

13. The method according to claim 10 wherein the turbocharger system operates with an engine that has an airflow requirement and further comprising the steps of: varying the variable throat to provide the flow stream with the subsonic speed throughout the inlet duct when the airflow requirement is changing; and varying the variable throat to provide the flow stream with the supersonic speed when the airflow requirement is consistent.

14. The method according to claim 10 further comprising the steps of providing the inlet duct with a pneumatic element; and supplying the pneumatic element with pressurized air to vary the throat.

15. A turbocharger system for use with an internal combustion engine comprising:

a compressor that has a compressor inlet;

an inlet duct connecting to the compressor inlet, the inlet duct defining an inlet passage, wherein the compressor induces a flow stream in the inlet passage;

wherein the inlet duct defines a smooth nozzle which has a converging section leading to a throat and a diverging section between the throat and the compressor inlet;

wherein the inlet duct has a wall that defines a profile of the converging section, the throat and the diverging section, and wherein the wall is moveable to enlarge and reduce the throat, wherein the wall is configured to accelerate the flow stream at the throat to a first speed equal to the speed of sound and to accelerate the flow stream to the supersonic speed beyond the throat and into the diverging section.

16. The turbocharger system according to claim 15 wherein the throat is variable to accelerate the flow stream to a supersonic speed.

17. The turbocharger system according to claim 15 wherein the throat has a first cross sectional area and the diverging section has a second cross sectional area and wherein the second cross sectional area is at least five times as large as the first cross sectional area.

18. The turbocharger system according to claim 16 wherein the supersonic speed is limited to Mach 1.2.

19. The turbocharger system according to claim 15 wherein a normal shock is propagated in the flow stream and wherein the flow stream has a first total pressure before the normal shock and a second total pressure after the normal shock and wherein the second total pressure is at least ninety-nine percent of the first total pressure.

20. The product according to claim 8 wherein the throat is the throat of a nozzle and wherein the shaped center element is suspended in the flow stream by a support to translate through the throat.

21. The product according to claim 20 wherein the shaped center element includes a tip and wherein the support is positioned by a spring system that automatically adjusts the position of the tip based on status of the flow stream.

22. The product according to claim 5 wherein the inlet passage has a nozzle profile and wherein the section defines a complete side of the nozzle profile of the inlet passage.

* * * * *